US009458984B2

(12) United States Patent
Jang

(10) Patent No.: US 9,458,984 B2
(45) Date of Patent: Oct. 4, 2016

(54) LIGHT EMITTING DEVICE

(71) Applicant: LG Innotek Co., Ltd., Seoul (KR)

(72) Inventor: Kee Youn Jang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/161,537

(22) Filed: Jan. 22, 2014

(65) Prior Publication Data

US 2014/0133147 A1 May 15, 2014

Related U.S. Application Data

(63) Continuation of application No. 12/818,656, filed on Jun. 18, 2010, now Pat. No. 8,646,940.

(30) Foreign Application Priority Data

Jul. 23, 2009 (KR) ..... 10-2009-0067429

(51) Int. Cl.
*F21V 7/00* (2006.01)
*F21V 7/22* (2006.01)
(Continued)

(52) U.S. Cl.
CPC ..... *F21V 7/00* (2013.01); *F21V 7/0008* (2013.01); *F21V 7/0025* (2013.01); *F21V 7/045* (2013.01); *F21V 7/22* (2013.01); *F21V 19/001* (2013.01); *F21V 19/04* (2013.01); *F21V 29/004* (2013.01);
(Continued)

(58) Field of Classification Search
CPC .. F21V 7/0008; F21V 7/0041; F21V 7/0033; F21V 7/0025
See application file for complete search history.

(56) References Cited

U.S. PATENT DOCUMENTS

2002/0105807 A1* 8/2002 Loughrey ..... F21S 8/02 362/278
2003/0034985 A1 2/2003 Needham Riddle et al.
(Continued)

FOREIGN PATENT DOCUMENTS

JP 1994350140 12/1994
JP 1999249131 9/1999
(Continued)

OTHER PUBLICATIONS

Machine translation of KR 20060037637.*
(Continued)

*Primary Examiner* — Anh Mai
*Assistant Examiner* — Zachary J Snyder
(74) *Attorney, Agent, or Firm* — Birch, Stewart, Kolasch & Birch, LLP

(57) ABSTRACT

A light emitting device includes: a frame having an opening; at least one light emitting diode (LED) disposed on the frame; a reflector disposed on the frame; and a reflective protrusion projecting from the reflector, wherein light emitted from at least one light emitting diode is reflected by the reflector through the opening, wherein the vertical axis of the reflective protrusion is perpendicular to a plane formed by extending the upper surface of the frame, wherein the upper surface of the frame contacts the reflector, and wherein a distance between two LEDs with one LED placed therebetween is greater than a distance between one LED and the reflector. Because a light source is disposed on the frame of the light emitting device, it is possible to easily exchange the light source of the light emitting diode by removing and attaching the frame without disassembling the entire lighting device.

19 Claims, 6 Drawing Sheets

(51) Int. Cl.

| | |
|---|---|
| ***F21V 19/00*** | (2006.01) |
| ***F21V 19/04*** | (2006.01) |
| ***F21V 7/04*** | (2006.01) |
| ***F21V 29/00*** | (2015.01) |
| ***F21V 29/74*** | (2015.01) |
| *F21S 8/02* | (2006.01) |
| *F21Y 101/02* | (2006.01) |
| *F21Y 103/02* | (2006.01) |

(52) U.S. Cl.
CPC ..... *F21V 29/74* (2015.01); *F21S 8/026* (2013.01); *F21Y 2101/02* (2013.01); *F21Y 2103/022* (2013.01)

(56) References Cited

U.S. PATENT DOCUMENTS

| | | | | |
|---|---|---|---|---|
| 2007/0171676 | A1 | 7/2007 | Chang | |
| 2007/0217193 | A1* | 9/2007 | Lin et al. | 362/245 |
| 2008/0144328 | A1 | 6/2008 | Yagi et al. | |
| 2009/0185386 | A1 | 7/2009 | Wu | |
| 2009/0290343 | A1 | 11/2009 | Brown et al. | |

FOREIGN PATENT DOCUMENTS

| | | | | | |
|---|---|---|---|---|---|
| JP | 2006185653 | | | 7/2006 | |
| JP | 2009-016081 | A | | 1/2009 | |
| JP | 2009-019160 | A | | 1/2009 | |
| JP | 2009-026584 | A | | 2/2009 | |
| KR | 20060037637 | | * | 5/2006 | F21S 2/00 |
| KR | 20090050394 | | * | 5/2009 | F21S 2/00 |
| WO | 2007130536 | A2 | | 11/2007 | |
| WO | 2008146229 | A2 | | 12/2008 | |

OTHER PUBLICATIONS

Machine translation of KR 20090050394.*

* cited by examiner

LIGHT EMITTING DEVICE

CROSS-REFERENCE TO RELATED APPLICATIONS

This application is a Continuation application of U.S. application Ser. No. 12/818,656 filed Jun. 18, 2010, which claims priority under 35 U.S.C. §119 to Korean Patent Application No. 10-2009-0067429, filed on Jul. 23, 2009, the entirety of which are incorporated by reference in their entirety as if fully set forth herein.

BACKGROUND

1. Field

The present invention relates to a light emitting device including a light emitting diode.

2. Description of the Related Art

A light emitting diode (LED) may constitute a light emitting source by using a compound semiconductor material such as a GaAs based material, AlGaAs based material, GaN based material, InGaN based material, InGaAlP based material and the like.

LED is packaged and used as a light emitting device emitting various colors. There have been many active researches for utilizing the LED as a light source in the field of the lighting device.

SUMMARY

One aspect of this invention includes a light emitting device. The light emitting device includes: a frame having an opening; at least one light emitting diode (LED) disposed on the frame; a reflector disposed on the frame; and a reflective protrusion projecting from the reflector towards the opening, wherein light emitted from at least one light emitting diode is reflected by the reflector through the opening, wherein a vertical axis of the reflective protrusion is perpendicular to a plane formed by extending an upper surface of the frame, wherein the upper surface of the frame contacts the reflector, and wherein a distance between two LEDs with one LED placed therebetween is greater than a distance between one LED and the reflector.

Another aspect of this invention includes a light emitting device. The light emitting device includes: a frame formed with an opening therethrough; a heat radiator disposed on an outer portion of the frame; at least one light emitting diode (LED) disposed on the frame; a reflector disposed on the frame; and a reflective protrusion projecting from the reflector towards the opening, wherein the light emitted from the at least one light emitting diode is reflected by the reflector through the opening, wherein a vertical axis of the reflective protrusion is perpendicular to a plane formed by extending an upper surface of the frame, wherein the upper surface of the frame contacts the reflector, and wherein a distance between two opposite LEDs is greater than a distance between one LED and the reflector.

Another aspect of this invention includes a light emitting device. The light emitting device includes: a circular frame having an opening therethrough; a plurality of light emitting diodes positioned around the circular frame; a dome-shaped reflector comprising an inner reflective surface, the dome-shaped reflector covering the plurality of light emitting diodes and reflecting light emitted from the plurality of light emitting diodes to the opening; and a reflective protrusion projecting from the inner reflective surface of the dome-shaped reflector towards the opening, wherein a vertical axis of the reflective protrusion is perpendicular to a plane formed by extending an upper surface of the frame, wherein the upper surface of the frame contacts the reflector, wherein a distance between two LEDs with one LED placed therebetween is greater than a distance between one LED and the reflector, and wherein a distance between two opposite LEDs is greater than a distance between the two LEDs with one LED placed therebetween.

BRIEF DESCRIPTION OF THE DRAWINGS

The embodiment will be described in detail with reference to the following drawings.

DETAILED DESCRIPTION OF EMBODIMENTS

In description of an embodiment, when it is mentioned that each panel, a member, a frame, a sheet, a plate or substrate and the like are formed "on" or "under" each panel, the member, the frame, the sheet, the plate or substrate and the like, it means that the mention includes a case where each panel, a member, a frame, a sheet, a plate or substrate and the like are formed "directly" or "by interposing another layer (indirectly)". A criterion for "on" and "under" of each component will be described based on the drawings. A size of each component of the drawings is magnified for description thereof. The size of each component does not necessarily mean its actual size.

Hereinafter, embodiments will be described in a more detailed manner with reference to the accompanying drawings.

Figure 1:
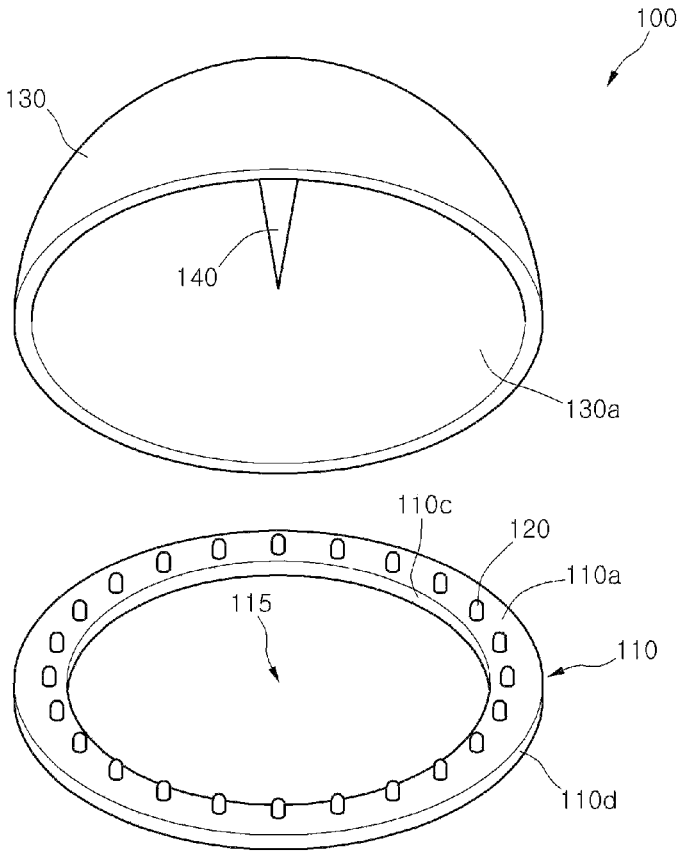
FIG. 1 is an exploded perspective view of a light emitting device according to a first embodiment.
Figure 2A:
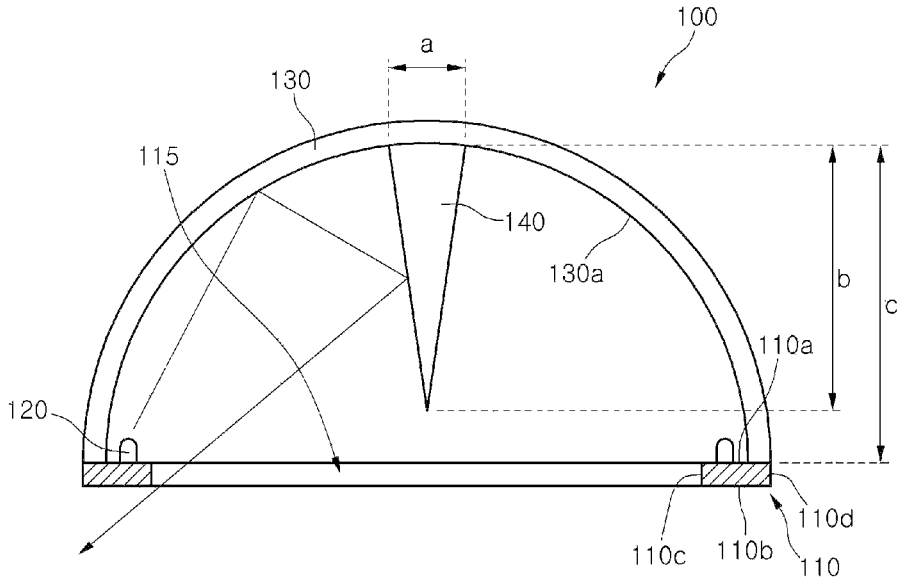
FIGS. 2*a* and 2*b* area cross sectional view of a light emitting device according to a first embodiment.
Figure 2B:
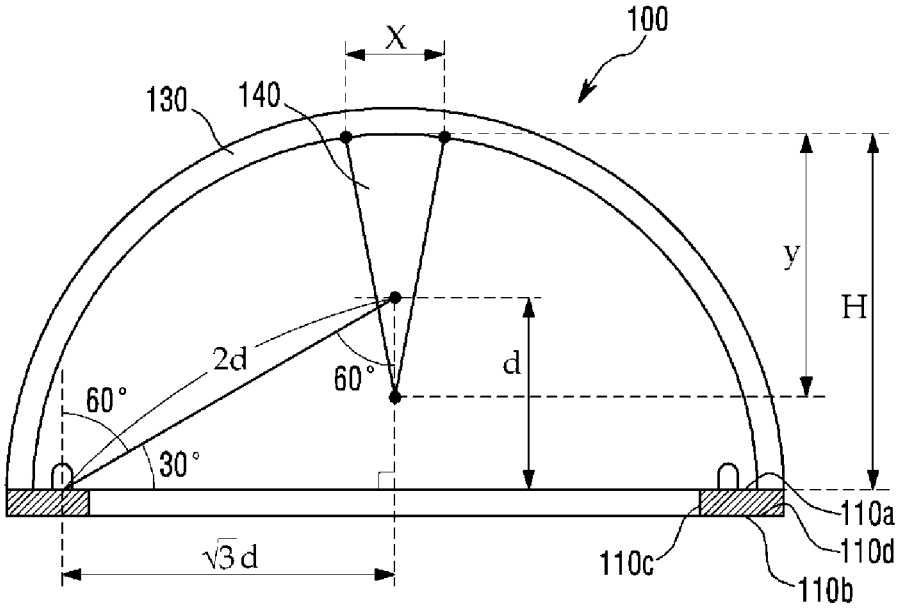
Figure 3:
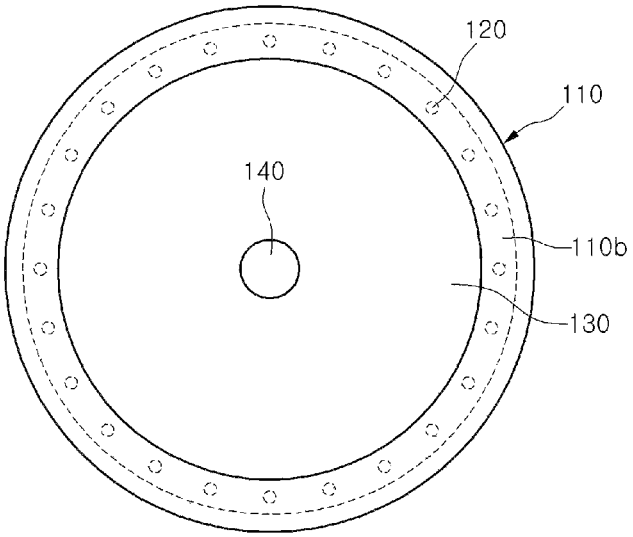
FIG. 3 is a bottom view of a light emitting device according to a first embodiment.
Figure 4:
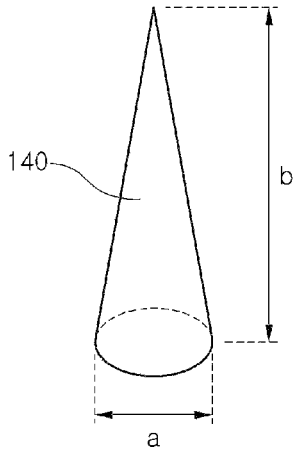
FIG. 4 is an enlarged view showing only a reflective protrusion of a light emitting device according to a first embodiment.

FIG. 1 is an exploded diagram showing perspective view of a light emitting device according to a first embodiment. FIGS. 2*a* and 2*b* are a cross sectional view of a light emitting device according to a first embodiment. FIG. 3 is a bottom view of a light emitting device according to a first embodiment. FIG. 4 is an enlarged view showing only a reflective protrusion of a light emitting device according to a first embodiment.

The preferred embodiment includes a circular frame, one of ordinary skill in the art will appreciate that the frame can take on any one of a number of shapes.

Referring to FIGS. 1 to 4, a lighting emitting device 100 according to the embodiment includes a frame 110 having an opening 115, at least one light emitting diode 120 disposed on the frame 110, a reflector 130 which reflects light irradiated from the light emitting diodes 120 and emits the light through the opening 115, and at least one reflective protrusion 140 which is formed on a reflective surface 130*a* of the reflector 130 and determines an orientation angle of the light emitted through the opening 115.

The reflective protrusion 140 can be integrally formed on the reflector 130. For another example, the reflective protrusion 140 can be manufactured to be attached to and detached from the reflector 130.

The frame 110 has a ring shape surrounding the opening 115. The frame 110 includes an upper surface 110*a*, a lower surface 110*b*, an inner lateral surface 110*c* surrounding the opening 115, and an outer lateral surface 110*d*.

The frame 110 can be attached and detached. Therefore, when the frame 110 is applied to a built-in lighting device, the frame 110 having the light emitting diode enables the built-in lighting device to be exchanged without taking out or disassembling the built-in lighting device. Therefore, since a light source is provided to the frame of the light emitting device according to the embodiment, it is possible to easily exchange the light source of the light emitting diode by detaching and attaching the frame without disassembling the entire lighting device.

The light emitting diodes 120 may be mounted on the upper surface 110*a* of the frame 110 separately from each other by a predetermined interval.

The light emitting diodes 120 may be arranged along the frame 110 in a line or a plurality of lines. The figures show that the light emitting diodes 120 are arranged in the form of a line.

Meanwhile, a zener diode (not shown) may be disposed on the frame 110 to protect the light emitting diode 120.

The light emitting diode 120 may emit a target light, for example, white light and create a desired light through a mixture of lights from a plurality of the light emitting diodes 120. Also, the light emitting diode 120 may generate target lights having various colors in accordance with the intention of a user.

While the light emitting diode 120 emits the light on the upper surface 110*a* of the frame 110, there is no limit to the light emission type of the light emitting diode 120.

The frame 110 supplies an electric power to the light emitting diode 120.

The frame 110 may function as a printed circuit board which is electrically coupled to the light emitting diodes 120.

The frame 110 may comprises a single layer substrate or a multi layer substrate. A wiring pattern may be formed on the inner surface of the frame 110 or on the lower surface of the frame 110. There is no limit to the mounting method and mounting pattern of the light emitting diode 120.

The reflector 130 is disposed in a light irradiation direction in order to reflect the light irradiated from the light emitting diode 120.

The reflector 130 may have a hemisphere shape. The reflector 130 does not necessarily have a hemisphere shape, however, various shapes such as a conical shape, a cylindrical shape, a cannon ball shape and a polygonal shape and the like can be also applied to the reflector 130 in consideration of a reflection efficiency and an optical uniformity.

The concave surface of the reflector 130 actually functions as the reflective surface 130*a* reflecting the light irradiated from the light emitting diode 120.

The reflective surface 130*a* may comprise a material having an excellent optical reflection efficiency.

The reflector 130 may be coupled to the upper surface 110*a* of the frame 110 where the light emitting diodes 120 are placed inside the reflector 130.

Though not shown, the reflector 130 and the frame 110 can be coupled to each other by using fastening means. The fastening means includes a fastening member or an adhesive member.

At least one reflective protrusion 140 is formed on some areas of the reflective surface 130*a*.

The reflective protrusion 140 is integrally formed with the reflector 130 or is adhered to some areas of the reflective surface 130*a*.

The surface of the reflective protrusion 140 is made of the same material as that of the reflective surface 130*a*.

The reflective protrusion 140 may have a conical shape.

The reflective protrusion 140 has its bottom surface contacting with the reflector 130 and has its vertex facing the opening 115.

The axis of the reflective protrusion 140 may be perpendicular to a plane formed by extending the upper surface 110*a* of the frame 110.

The central point of the bottom surface of the reflective protrusion 140 may be the farthest from a plane formed by extending the upper surface 110*a* of the frame 110 in a vertical direction to the plane.

An orientation angle of the light which is reflected by the reflective surface 130*a* and is emitted through the opening 115 varies according to the height "b" of the reflective protrusion 140 and the diameter "a" of the bottom surface of the reflective protrusion 140.

The aforementioned orientation angle of the light refers to a diffusion angle of light emitted through the opening 115 of the frame 110. An effective lighting area may vary according to the orientation angle of light.

For example, if the height of the reflective protrusion 140 is increased, the orientation angle of light may be increased, thus the effective lighting area may be increased. Otherwise, if the height of the reflective protrusion 140 is decreased, the orientation angle of light may be decreased and the effective lighting area may be decreased.

The height "b" of the reflective protrusion 140 from the reflector 130 may be less than a vertical height "c" from the frame 110 to the reflector 130 point which is the farthest from the frame 110.

On the other hand, the height "b" of the reflective protrusion 140 from the reflector 130 may be greater than the vertical height "c" from the frame 110 to the reflector 130 point which is the farthest from the frame 110.

Meanwhile, in FIG. 2*b*, the preferable width and length of the reflective protrusion 140 will be described based on the orientation angle of the light emitting diode 120.

For example, it is assumed that the orientation angle of the light emitting diode 120 is 120°. Since the light emitting diode 120 irradiates light in a vertical direction, the light emitting area of the light emitting diode 120 forms an angle of 30° with the frame 110. Here, if the radius of the frame 110 is defined as "$\sqrt{3}$ d", the lengths of the sides of a triangle area 400 formed by the light emitting area and the frame are defined as "2 d" and "d" respectively.

When the reflective protrusion 140 has a conical shape, it is preferable that the diameter "x" of the bottom surface of the reflective protrusion 140 is less than $\leqslant 3$ d.

Meanwhile, if the reflector 130 has a constant height "H", it is preferable that the height "y" of the reflective protrusion 140 is greater than a length difference between the height "H" of the reflector 130 and the vertical length "d" of the triangle area 400. That is, it is required that a relational expression of $y>H-d$ should be satisfied. If $y<H-d$, a part of the light irradiated from the light emitting diode 120 is directly incident on the opposite side of the reflector without being reflected by the reflective protrusion 140 and is immediately irradiated to the outside of the frame 110. As a result, indirect lighting effect is reduced.

The height "b" of the reflective protrusion 140 may be equal to or greater than 0 mm. The reflective protrusion 140 may be formed to be larger than bumpy patterns formed on the surface of the reflective surface 130*a*. The bumpy patterns are formed for scattering light.

The lighting emitting device 100 having such a structure can be used as an indirect lighting device.

The reflective protrusion 140 according to the embodiment makes it possible to obtain a desired effective lighting area by adjusting the orientation angle of light, to improve an optical uniformity and to prevent a glare phenomenon.

In addition, even if any one of the plurality of the light emitting diodes 120 is disabled, the disabled light rarely affect the entire light. Therefore, there is an effect of lengthening the time period for using the lighting device, thereby reducing the manufacturing cost.

At least any one among the surface of the reflective protrusion 140 and the reflective surface 130*a* of the reflector 130 may have roughness. A degree of the roughness of the reflective surface 130*a* and a degree of the surface roughness of the reflective protrusion 140 may be different from each other according to the characteristic and design of the lighting.

The light irradiated from the light emitting diode 120 may be scattered while reflected because of the roughness of the reflective surface 130*a* of the reflector 130 and the roughness of the reflective protrusion 140, so a lighting uniformity can be improved.

As a result, in the effective lighting area of the light irradiated from the light emitting device 100, a hot spot is removed and a luminance distribution of the light is improved.

Figure 5:
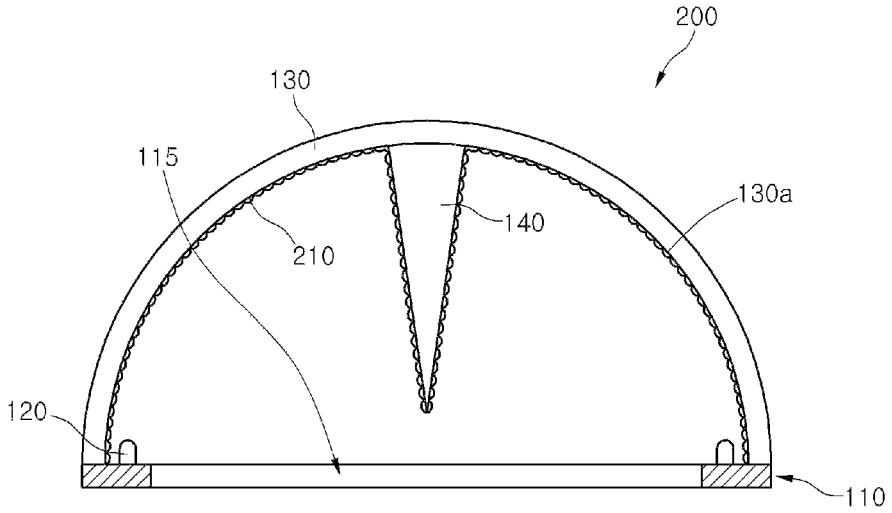
FIG. 5 is a cross sectional view of a light emitting device according to a second embodiment.

FIG. 5 is a cross sectional view of a light emitting device according to a second embodiment.

Here, regarding a light emitting device 200 shown in FIG. 5, the same reference numerals will be assigned to the same elements and structure as those of the first embodiment, and detailed descriptions thereof will be omitted.

Referring to FIG. 5, at least any one among the surface of the reflective protrusion 140 and the reflective surface 130*a* of the reflector 130 may have patterns 210 formed thereon and roughness. The patterns may be a rough patterns or bumpy patterns. A degree of the roughness of the reflective surface 130*a* and a degree of the surface roughness of the reflective protrusion 140 may be different from each other according to the characteristic and design of the lighting.

The light irradiated from the light emitting diode 120 may be scattered while reflected by the bumpy patterns 210 which are formed on both the reflective surface 130*a* of the reflector 130 and the surface of the reflective protrusion 140.

Since the light emitting device 200 does not require a separate diffusion sheet and a separate scattering sheet and the like, it is possible to maintain the light intensity of the light emitting diode 120 of equal to or greater than 90%.

As a result, in the effective lighting area of the light irradiated from the light emitting device 200, a hot spot is removed and a luminance distribution of the light is improved.

Figure 6:
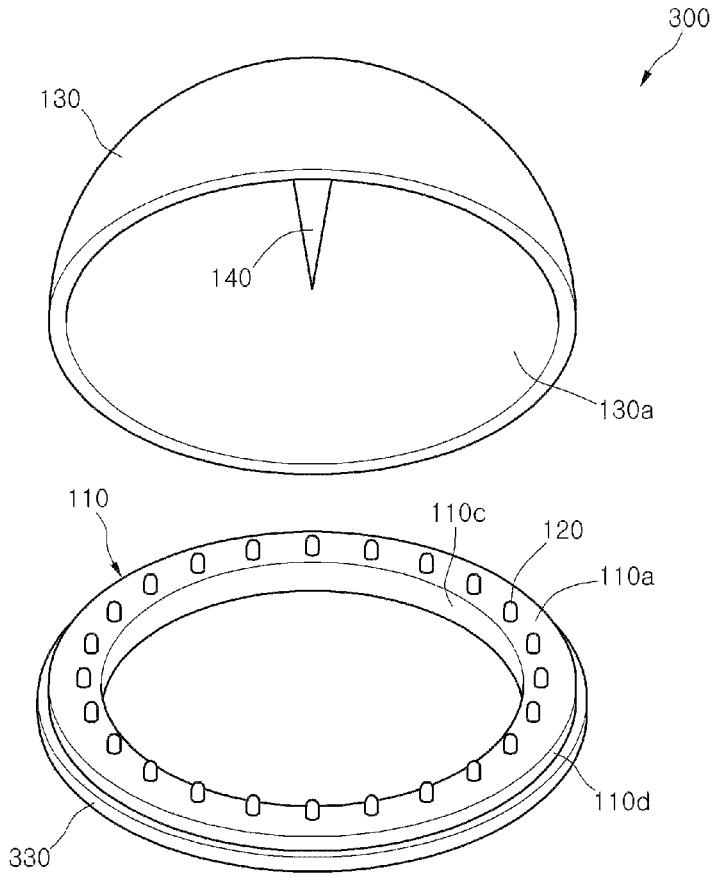
FIG. 6 is an exploded diagram showing perspective view of a light emitting device according to a third embodiment.
Figure 7:
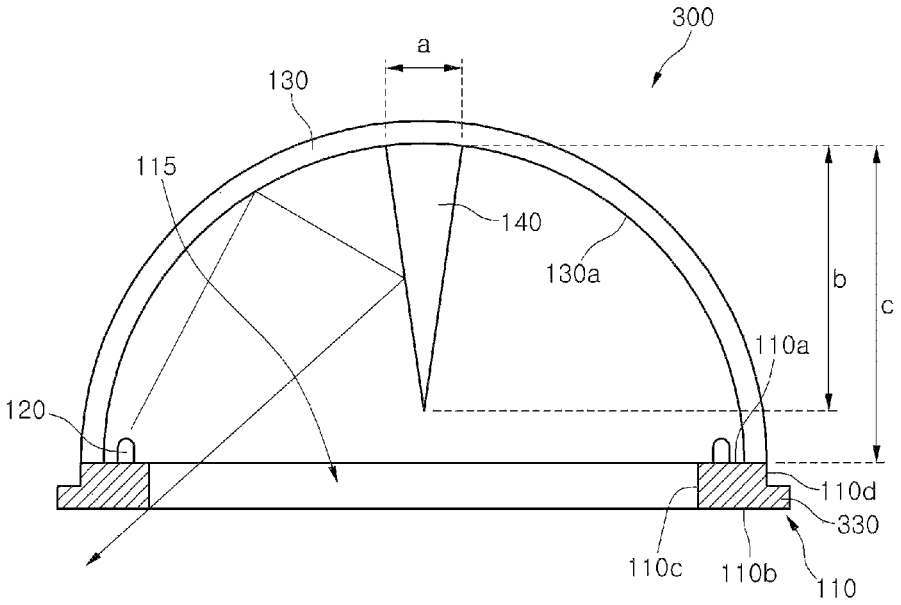
FIG. 7 is a cross sectional view of a light emitting device of FIG. 6.

FIG. 6 is an exploded perspective view of a light emitting device according to a third embodiment. FIG. 7 is a cross sectional view of a light emitting device of FIG. 6.

Here, regarding a light emitting device 300 shown in FIGS. 6 and 7, the same reference numerals will be assigned to the same elements and structure as those of the first embodiment, and detailed descriptions thereof will be omitted.

Referring to FIGS. 6 and 7, a lighting emitting device 300 according to the embodiment includes a frame 110 having both an opening 115 formed therein and a heat radiator 330 formed on the outer circumference thereof, at least one light emitting diode 120 disposed on the frame 110, a reflector 130 which reflects light irradiated from the light emitting diodes 120 and emits the light through the opening 115, and a reflective protrusion 140 which is formed inside the reflector 130 and determines an orientation angle of the light emitted through the opening 115.

The frame 110 includes an upper surface 110*a*, a lower surface 110*b*, an inner lateral surface 110*c* and an outer lateral surface 110*d*. The heat radiator 330 is formed to surround the lower part of the outer lateral surface 110*d*.

There is a difference in diameter between the heat radiator 330 and the upper surface 110*a* of the frame 110. The heat radiator 330 projects out from the outer lateral surface 110*d*.

Since the heat radiator 330 obtains an area for radiating heat, it is possible to overcome the problem of radiation heat of the light emitting diode 120 and to obtain reliability.

The frame 110 can be integrally formed with the heat radiator 330 or formed to be connected to the heat radiator 330.

The reflector 130 may have a hemisphere shape. The concave surface of the reflector 130 forms a reflective surface 130*a*.

The reflective protrusion 140 is formed on some areas of the reflective surface 130*a*. The surface of the reflective protrusion 140 is made of the same material as that of the reflective surface 130*a*.

The reflective protrusion 140 has a conical shape. The reflective protrusion 140 has its bottom surface contacting with the reflective surface 130*a* and has its vertex facing the opening 115.

The height "b" of the reflective protrusion 140 from the reflector 130 may be less than a vertical height "c" from the frame 110 to the reflector 130 point which is the farthest from the frame 110.

The reflective protrusion 140 according to the embodiment makes it possible to obtain a desired effective lighting area by adjusting the orientation angle of light, to improve an optical uniformity and to prevent a glare phenomenon.

An orientation angle of the light which is reflected by the reflective surface 130*a* and is emitted through the opening 115 varies according to the height "b" of the reflective protrusion 140 and the diameter "a" of the bottom surface of the reflective protrusion 140.

At least any one among the surface of the reflective protrusion 140 and the reflective surface 130*a* of the reflector 130 may have roughness. A degree of the roughness of the reflective surface 130*a* and a degree of the surface roughness of the reflective protrusion 140 may be different from each other according to the characteristic and design of the lighting.

The light irradiated from the light emitting diode 120 may be scattered while reflected because of the roughness of the reflective surface 130*a* of the reflector 130 and the surface roughness of the reflective protrusion 140, so a lighting uniformity can be improved.

As a result, in the effective lighting area of the light irradiated from the light emitting device 300, a hot spot can be removed and a luminance distribution of the light can be improved.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A light emitting device comprising:

a circular frame including an opening and an upper surface;

a light emitting diode (LED) on the upper surface of the circular frame;

a reflector including a hemispheric reflection surface on the circular frame; and a conical reflective protrusion projecting from an upper end of the reflector towards the opening, wherein light emitted from the light emitting diode and directly incident on the conical reflective protrusion is reflected by the reflector, wherein the light reflected by the reflector passes through the opening, wherein a vertical axis of the conical reflective protrusion is perpendicular to a plane formed by extending the upper surface of the circular frame, wherein the upper surface of the circular frame contacts the reflector, and wherein, $y>H-R\times\cot(\theta)$, wherein "y" is a height of the conical reflective protrusion, "H" is a height of the reflector, "R" is a radius of the circular frame, and "θ" is a half of an orientation angle of the LED, wherein "y", "H", and "R" are all a same unit of measure and "θ" is in degrees, wherein "θ" is an angle relative to the vertical axis, and wherein a vertex of the conical reflective protrusion is closer to the opening than the upper end of the reflector.

2. The light emitting device of claim 1, wherein the conical reflective protrusion contacts an inner surface of the reflector.

3. The light emitting device of claim 1, wherein the conical reflective protrusion is formed on an inner surface of the reflector.

4. The light emitting device of claim 1, wherein the vertex of the conical reflective protrusion is closer to the opening than a point where a vertical axis of the conical reflective protrusion meets light from the LED emitted to the conical reflective protrusion at a minimum angle with relation to the upper surface of the circular frame.

5. The light emitting device of claim 1, wherein at least one of the conical reflective protrusion and the reflector has a patterned surface.

6. The light emitting device of claim 5, wherein the patterned surface comprises a bumpy pattern to scatter reflected light.

7. The light emitting device of claim 5, wherein the patterned surface is a rough surface to scatter reflected light.

8. The light emitting device of claim 1, further comprising a heat radiator, wherein the heat radiator is circular in shape, and wherein the heat radiator surrounds an outer circumference of the circular frame such that a diameter associated with the heat radiator is greater than a diameter associated with the circular frame.

9. The light emitting device of claim 8, wherein the circular frame is integrally formed with or connected to the heat radiator.

10. The light emitting device of claim 1, wherein the circular frame is detachably connected to the reflector.

11. A light emitting device comprising:

a circular frame with an opening therethrough comprising an upper surface;

a heat radiator on an outer portion of the circular frame;

a light emitting diode (LED) on the upper surface of the circular frame;

a reflector including a hemispheric reflection surface on the circular frame; and a conical reflective protrusion projecting from an upper end of the reflector towards the opening, wherein light emitted from the light emitting diode and directly incident on the conical reflective protrusion is reflected by the reflector, wherein the light reflected by the reflector passes through the opening, wherein a vertical axis of the conical reflective protrusion is perpendicular to a plane formed by extending the upper surface of the circular frame, wherein the upper surface of the circular frame contacts the reflector, wherein the circular frame includes an upper surface on which the LED is directly disposed, a lower surface, an inner lateral surface defining the opening, and an outer lateral surface, wherein the circular frame includes a projection extended from a lower part of the outer lateral surface, and wherein a vertex of the conical reflective protrusion is closer to the opening than the upper end of the reflector.

12. The light emitting device of claim 11, wherein the conical reflective protrusion is on an inner surface of the reflector.

13. The light emitting device of claim 11, wherein the conical reflective protrusion contacts an inner surface of the reflector.

14. The light emitting device of claim 11, wherein at least one of the conical reflective protrusion and the reflector has a patterned surface to scatter light.

15. The light emitting device of claim 11, wherein the circular frame is detachably connected to the reflector.

16. The light emitting device of claim 11, wherein the vertex of the conical reflective protrusion is closer to the opening than a point where the vertical axis of the conical reflective protrusion meets light from the LED emitted to the conical reflective protrusion at a minimum angle with relation to the upper surface of the circular frame.

17. The light emitting device of claim 14, wherein the patterned surface comprises a bumpy pattern.

18. The light emitting device of claim 14, wherein the patterned surface is a rough surface.

19. The light emitting device of claim 11, wherein, $y>H-R\times\cot(\theta)$, wherein "y" is a height of the conical reflective protrusion, "H" is a height of the reflector, "R" is a radius of the circular frame, and the "θ" is a half of an orientation angle of the LED, wherein "y", "H", and "R" are all a same unit of measure and "θ" is in degrees, and wherein "θ" is an angle relative to the vertical axis.

* * * * *